US011771185B2

(12) United States Patent
Avitall et al.

(10) Patent No.: US 11,771,185 B2
(45) Date of Patent: Oct. 3, 2023

(54) WRIST DISPENSER

(71) Applicant: READY SQUIRT, Milwaukee, WI (US)

(72) Inventors: Boaz Avitall, Milwaukee, WI (US); Patrick Santini, West Bend, WI (US)

(73) Assignee: READY SQUIRT, Milwaukee, WI (US)

( * ) Notice: Subject to any disclaimer, the term of this patent is extended or adjusted under 35 U.S.C. 154(b) by 93 days.

(21) Appl. No.: 17/308,268

(22) Filed: May 5, 2021

(65) Prior Publication Data

US 2021/0353016 A1 Nov. 18, 2021

Related U.S. Application Data

(60) Provisional application No. 63/065,030, filed on Aug. 13, 2020, provisional application No. 63/025,331, filed on May 15, 2020.

(51) Int. Cl.

| | |
|---|---|
| ***A44C 15/00*** | (2006.01) |
| ***A47K 5/12*** | (2006.01) |
| ***A44C 5/00*** | (2006.01) |

(52) U.S. Cl.

CPC ..... *A44C 15/002* (2013.01); *A44C 5/003* (2013.01); *A47K 5/1201* (2013.01); *A44C 5/0053* (2013.01)

(58) Field of Classification Search

CPC ..... A44C 15/002; A44C 5/003; A44C 5/0053; A47K 5/1201

USPC ..... 222/175

See application file for complete search history.

(56) References Cited

U.S. PATENT DOCUMENTS 2,707,581 A * 5/1955 Kaplan ..... B65D 75/5811 383/44
4,037,790 A * 7/1977 Reiser ..... A63H 37/00 472/52
4,153,185 A * 5/1979 Nilson ..... B65D 83/0094 222/212
4,241,850 A * 12/1980 Speer ..... F41H 9/10 116/DIG. 44

(Continued)

FOREIGN PATENT DOCUMENTS

WO WO-2007035366 A2 * 3/2007 ..... A44C 5/003
WO WO-2015008065 A1 * 1/2015 ..... A44C 5/003
WO 2017168417 A1 10/2017

*Primary Examiner* — Paul R Durand
*Assistant Examiner* — Michael J. Melaragno
(74) *Attorney, Agent, or Firm* — Bradley J. Thorson; DeWitt LLP

(57) ABSTRACT

A wrist-mounted fluid dispenser includes a wristband and a dispenser pouch. The dispenser pouch includes a reservoir chamber and a dispensing nozzle. The dispenser pouch is preferably formed by bonding two sheets of material to each other. An orifice is formed between the dispensing nozzle and the reservoir chamber. A nozzle slit is formed at an end edge of the wristband. The reservoir chamber is either rolled up and inserted through the nozzle slit or sown into the wristband. The reservoir chamber is filled with a fluid solution with a syringe or hand pump equipped with hypodermic blunt needle or the like. One's hand is inserted through the wrist-mounted liquid dispenser. An end of the dispensing nozzle is folded when not used, such that the nozzle is located between the wrist and an inside surface of the wristband. A second embodiment of the wrist-mounted liquid dispenser includes a double chamber dispenser pouch.

22 Claims, 6 Drawing Sheets

(56) References Cited

U.S. PATENT DOCUMENTS 4,736,876 A * 4/1988 Kriss ..... A45F 5/00 224/267
D315,245 S * 3/1991 Envall ..... D3/202
5,207,355 A * 5/1993 Thomsen ..... A47K 5/1215 222/105
5,358,144 A * 10/1994 Mock ..... F41H 9/10 222/39
5,571,260 A * 11/1996 Krug ..... A45F 3/16 224/660
5,669,529 A * 9/1997 Levit ..... A45F 3/20 222/105
5,957,347 A * 9/1999 White ..... A63B 21/0602 224/148.1
6,126,041 A * 10/2000 DiTomasso ..... A63B 21/065 224/148.1
6,173,866 B1 1/2001 Taylor, Jr. et al.
6,244,468 B1 * 6/2001 Farmer ..... B65D 75/5866 222/212
7,004,354 B2 * 2/2006 Harper ..... B65D 75/58 222/212
7,285,114 B2 * 10/2007 Harper ..... A61B 90/80 206/532
7,316,332 B2 * 1/2008 Powers ..... A61M 35/003 222/491
7,828,176 B2 * 11/2010 Harper ..... A61J 1/067 222/207
9,238,539 B2 * 1/2016 Lynch ..... A45F 5/00
9,402,454 B2 * 8/2016 Landy ..... B08B 1/006
9,578,935 B2 2/2017 Horgan
D811,729 S * 3/2018 Bysshe ..... D3/218
9,943,159 B1 * 4/2018 Novikova ..... A45D 40/22
10,470,973 B2 * 11/2019 Machado Pires ..... A61J 1/16
10,646,076 B2 * 5/2020 Shaukat ..... A44C 5/20
10,653,232 B1 5/2020 Russo
10,737,872 B2 * 8/2020 Kinarti ..... A45D 34/00
11,122,940 B1 * 9/2021 Winn ..... B65D 33/1666
D944,514 S * 3/2022 Anthony ..... D3/215
2004/0055482 A1 * 3/2004 Grounds ..... B41F 17/00 101/35
2004/0111071 A1 * 6/2004 Powers ..... A47K 5/122 604/310
2004/0162534 A1 * 8/2004 Powers ..... A47K 5/122 604/310
2005/0124945 A1 * 6/2005 Powers ..... A61M 35/003 604/310
2007/0262091 A1 * 11/2007 Harper ..... A61J 1/067 222/207
2008/0067193 A1 * 3/2008 Powers ..... A47K 5/122 222/494
2008/0193495 A1 * 8/2008 Kharazmi ..... A45F 5/00 424/404
2008/0230560 A1 9/2008 Powers et al.
2010/0084432 A1 * 4/2010 Pelfrey ..... B05B 11/00412 222/207
2010/0237115 A1 * 9/2010 Booker ..... A61J 1/035 224/267
2011/0155765 A1 * 6/2011 Properzi ..... A47K 5/1201 222/401
2011/0262209 A1 * 10/2011 Landy ..... B08B 1/006 401/209
2012/0118915 A1 * 5/2012 Harper ..... B05B 11/3032 222/207
2012/0241465 A1 * 9/2012 Genosar ..... B05B 11/0078 222/105
2012/0282011 A1 * 11/2012 Francois ..... A61L 2/18 401/196
2015/0158042 A1 * 6/2015 Parker ..... A44C 15/005 222/183
2016/0044997 A1 * 2/2016 Horgan ..... A61M 35/003 222/175
2016/0339482 A1 11/2016 Landy
2017/0156454 A1 * 6/2017 Abadi ..... A44C 5/0053
2018/0373272 A1 * 12/2018 Kihm ..... B05B 12/004
2021/0315424 A1 * 10/2021 van Leeuwen ..... A44C 15/002
2021/0353788 A1 * 11/2021 Crawford ..... B05B 11/0056
2021/0378456 A1 * 12/2021 Singer ..... A44C 5/0007
2021/0393002 A1 * 12/2021 Ascencio ..... A47K 5/122
2022/0015583 A1 * 1/2022 Winn ..... A45F 5/00
2022/0061473 A1 * 3/2022 Newcomb ..... A61L 2/26

* cited by examiner

WRIST DISPENSER

CROSS-REFERENCED TO RELATED APPLICATIONS

This application is a non-provisional application of Application Nos. 63/025,331, filed May 15, 2020, and 63/065,030, filed Aug. 13, 2020 and claims priority from those applications which are also deemed incorporated by reference in their entirety in this application.

STATEMENT REGARDING FEDERALLY SPONSORED RESEARCH OR DEVELOPMENT

Not applicable

BACKGROUND OF THE INVENTION

I. Field of the Invention

The present invention relates generally to fluid dispensers and more specifically to a wrist-mounted dispenser, which allows a fluid, gel, or cream solution to be squirted into a wearer's hand.

II. Discussion of the Prior Art

U.S. Pat. No. 6,173,866 to Taylor, Jr. et al. discloses a wrist-carried water container apparatus. Patent Publication No. 2016/0339482 to Landy discloses a wristband wearable fluid application device. The wrist dispenser preferably includes a hand disinfectant, but other fluids may also be used.

Accordingly, there is a clearly felt need in the art for a wrist dispenser, which allows a fluid solution to be squirted into a wearer's hand.

SUMMARY OF THE INVENTION

The present invention provides a wrist-mounted dispenser for a disinfectant sanitizer, which allows a fluid, gel or cream to be squirted into the wearer's hand. The wrist dispenser preferably includes a wristband and a compressible dispenser pouch. However, the dispenser pouch could be contained in a sweatshirt wrist cuff or a shirt wrist cuff. The wristband is preferably a sweat absorbent wristband or a stretchable fabric that allows high resolution printing thereon, is reversible and that allows the entire band to have custom graphics printed thereon.

The pouch is preferably formed by heat sealing two sheets of flexible plastic material to each other to form a reservoir chamber and a dispensing nozzle. The material that the pouch may be made of is preferably double-layered, high-density polyethylene (HDPE) or similar material that is capable of self-sealing especially when wet.

The width of the dispensing nozzle is much smaller than the width of the reservoir chamber. An orifice is formed between the dispensing nozzle and the reservoir chamber. The width and shape of the orifice are determined by the viscosity of fluid employed in the reservoir chamber. A slit is formed at the end of the wristband that faces the hand and through which the nozzle can be made to extend. The reservoir chamber is rolled-up and inserted through the nozzle slit into the interior of the wristband via the slit, and then expanded within the wristband. Alternatively, the reservoir chamber may be is sewn into the wristband. It also can be sewn into a sweatshirt wrist cuff or a shirt wrist cuff.

The dispensing nozzle is made to extend from an end edge of the wristband, sweatshirt wrist cuff, or shirt wrist cuff closest to the wearer's hand, with the dispensing nozzle extending to the palm of a hand once the compressible chamber is so positioned. The reservoir chamber is then filled with a liquid solution, gel or cream with an irrigation type syringe or a specialized tubing that allows direct connection to a refill bottle equipped with a hand pump. Another means of filling the wristband is by using a hypodermic blunt needle or tubing connected to a syringe. The sweat wristband is well known in the art and needs not to be explained in further detail. One hand is inserted through the wristband or shirt cuff containing the wrist dispenser, such that the wrist dispenser is retained on the wrist with its dispensing nozzle located adjacent to the palm surface of one hand. The end of the dispensing nozzle may be folded back such that the nozzle is located between the wrist and an inside surface of the wristband when not in use. This kinks the nozzle preventing loss of the fluid. The end of the dispensing nozzle can then later be withdrawn from beneath the wristband to dispense the fluid. The user's other hand can be used to squeeze the reservoir chamber to dispense the sanitizing fluid into the user's hand.

A second embodiment of the wrist dispenser preferably includes the wristband and a double chamber dispenser pouch. The double chamber dispenser pouch may also be contained in a wristband or sweatshirt wrist cuff or a shirt wrist cuff. The double chamber dispenser pouch includes a reservoir chamber, a dispensing chamber, and a dispensing nozzle. The double chamber dispenser pouch is preferably formed by heat sealing two sheets of flexible plastic film material to each other to form the reservoir chamber, the dispensing chamber, and the dispensing nozzle. The width and volume of the dispensing nozzle is significantly smaller than the width of the dispensing chamber and adjusted based on the dosing desired. The outlet orifice and gating are at the end of the nozzle. A second orifice is formed between the dispensing chamber (dosing chamber) and the reservoir chamber. The configuration of this gate is critical for avoiding unwanted discharge from the wrist dispenser.

The unique configuration and opening gap of the outlet from the main reservoir chamber into the dosing chamber or the dispensing nozzle gate is defined by the viscosity of the fluid/gel/cream and the pressure needed to dispense the content.

The shape and size define the variety of liquid viscosities. The double-layered polyethylene self-seals especially when wet, and the fluid would not leak out of the nozzle unless a predetermined pressure is applied to the storage bag. The nozzle function is a balance between the size of the nozzle inlet from the main chamber and the size and shape of the gate to the channel. To allow a good seal while also allowing reasonable pressure to discharge the gel/fluid the size of the inlet gap, as well as the configuration of the gate, is critical to the function of the wrist-worn dispenser.

In the case of gel type fluid, the best gating from the reservoir chamber is an uneven gate. The application of pressure to the storage bag applies a force to the uneven gate deforming the outlet that opens the outlet gap allowing for the content of the storage bag to fill the dosing chamber. The gate at the tip of the nozzle allows the dosing chamber to fill and the dispensing is done by squeezing the dosing chamber from its base towards the palm of the hand. Another configuration is for the dispensing nozzle to consist of a dispensing channel without a dosing chamber.

Fluids that can be dispensed include substances, such as gels, liquids, disinfectants, lotions, perfumes, and any other suitable flowing substances.

The dispensing nozzle self-seals utilize the self-approximation of the polyurethane bilayer surfaces and physical concept that hydrogen bonds result in more significant force than air pressure for wet surfaces. Water is polar. Hydrogen atoms are positively charged and are attracted to the negatively charged oxygen atoms. this makes water stick to itself and bond wet surfaces.

A nozzle slit is formed at an end edge of the wristband that faces the wearer's hand. The reservoir chamber is rolled-up and inserted into the nozzle slit. The reservoir chamber is preferably sewn within the wristband or sewn into a sweatshirt wrist cuff. The dispensing chamber and dispensing nozzle would extend from the nozzle slit formed at an end edge of the wristband, sweatshirt wrist cuff or shirt wrist cuff, with the dispensing chamber and dispensing nozzle in contact with an inside surface of a wrist and hand. The reservoir chamber may be filled with a fluid solution using a hypodermic needle or the like. The athletic sweat wristband is well known in the art and needs not be explained in detail.

Alternatively, a dispenser entry slit may be formed in the wristband at its end opposite the one having the nozzle slit. The dispenser pouch or the double chamber dispenser pouch would then be inserted through the dispenser slit, and the dispensing chamber and the dispensing nozzle would extend through the nozzle slit. The dispenser slit would allow the dispenser pouch to be replaced. A flap may be used to cover the dispenser slit and held in place with a button, a magnet, Velcro, or the like. The flap may also be applied to a shirt wrist cuff.

By folding the nozzle back under the wristband not only removes it from the palm of the hand, but also creates a solid seal that would prevent any unintended spillage if pressure is inadvertently applied to the wristband.

In use, one hand is inserted through the wrist dispenser, such that the wrist dispenser is retained on a wrist with the dispensing nozzle located adjacent an inside surface of the one hand. The other hand may be used to squeeze the reservoir chamber to thereby fill the dispensing chamber. The dispensing chamber may then be squeezed to dispense the fluid into the one hand. Squeezing can be performed using the other hand or by pressing the wrist against the wearer's side or abdomen.

Accordingly, it is an object of the present invention to provide a wrist dispenser, which allows a solution, such as a disinfectant or sterilant, to be administered to one's hand.

Additional functional elements of the wristband may include one that allows the accommodation of a watch, an outer wrist pouch with a zipper to allow storage of such things as keys, a driver's license, a credit card, etc.

An important element is the ability to print high-resolution pictures, logos in any color using a high-resolution sublimation printer.

Furthermore, the wristband is designed to be reversible and can have a solid color on one side and a logo or other graphics on the other and can be used with either side displayed.

The refill configuration of the wrist dispenser may utilize a syringe or a pump bottle, both equipped with a tube or blunt tip needle that can be inserted into the dispensing outlet. The outlet gate at the nozzle seals around the refill needle and prevents spillage. Another configuration is for the reservoir chamber to be equipped with a one-way valve to allow direct injection into the bag.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts:

FIG. 11 depicts a wrist dispenser where the wristband has an outer compartment with a front or back seal mechanism, such as a zipper that allows for the storage of keys, credit cards and the like;

DESCRIPTION OF THE PREFERRED EMBODIMENT

Figure 1:
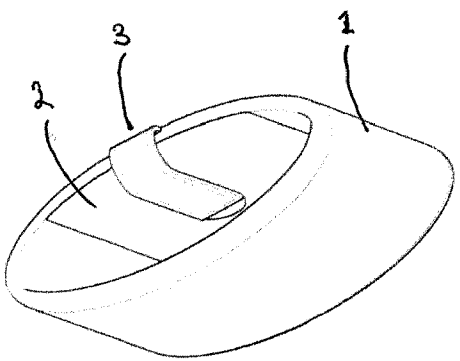
FIG. 1 is a perspective view of a wrist dispenser in accordance with the present invention, showing the wristband with the dispensing nozzle folded inward.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

With reference now to the drawings, and particularly to FIG. 1, there is shown a perspective view of a first embodiment of a wrist dispenser device showing a wristband 1 that contains a reservoir chamber 2 and a foldable nozzle 3. Wristband 1 is preferably a sweat wristband made of terrycloth, but other types of wristbands may also be used. The sweat wristband is typically used in sports activities and is fabricated from elastic material for retention on a wrist. Sweat wristbands are well known in the art and their construction need not be explained in further detail. In a more decorative wristband, an elastic fabric that allows high-resolution sublimation printing that can be logos, pictures, and any desired print pattern or solid colors can be made to create a reversible color and logos wristband. Reservoir chamber 2 is sewn in or otherwise affixed to wristband 1. Alternatively, the reservoir chamber can be rolled and inserted into the wristband via the slit from which the dispensing chamber and nozzle 3 are made to extend. The reservoir chamber is unfurled once within the wristband.

Figure 2:
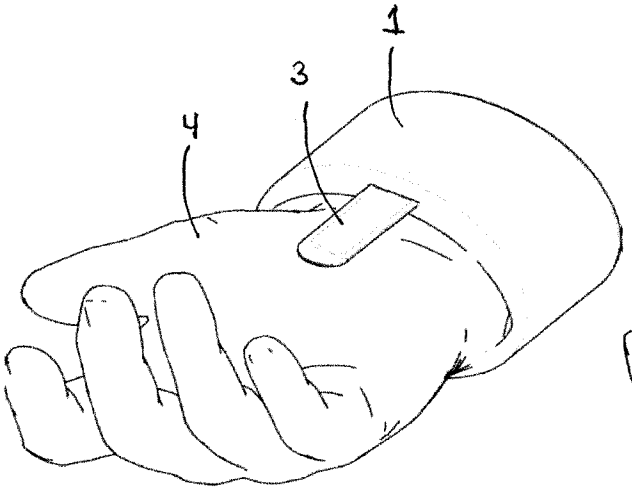
FIG. 2 depicts the wrist dispenser positioned in the wrist with the dispenser nozzle extended.
Figure 3:
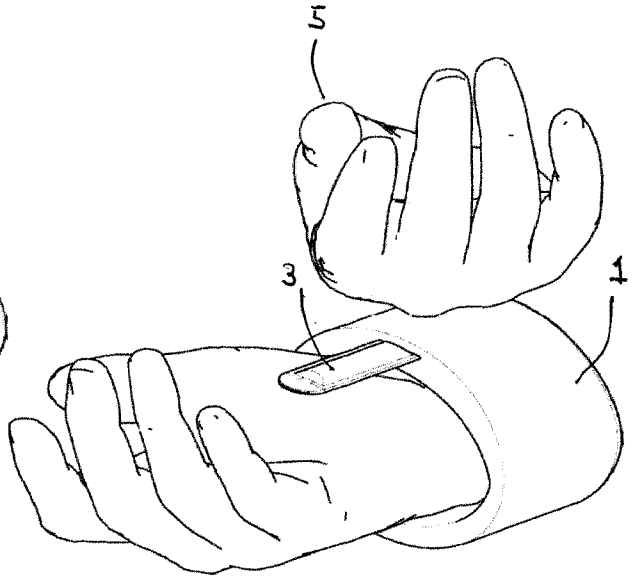
FIG. 3 depicts the reservoir chamber being placed under compression resulting in the stored fluid filling the dispenser chamber.
Figure 4:
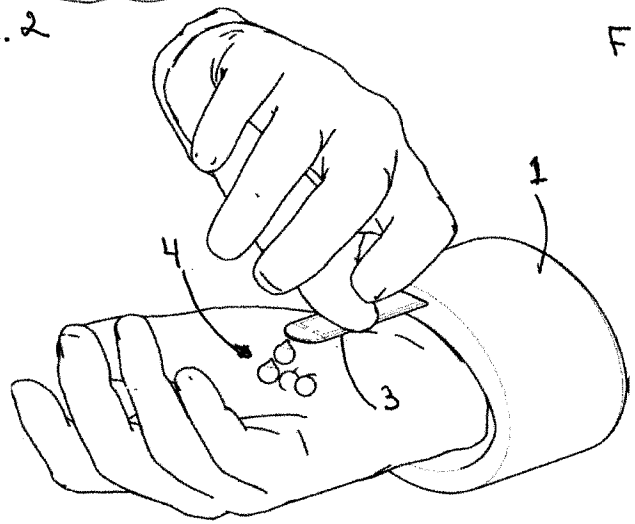
FIG. 4 shows the dispenser chamber being emptied out by extruding the fluid in the chamber to the palm of the hand.

As shown in FIG. 1, when the nozzle 3 is folded under the wristband, the wrist dispenser nozzle is kinked and no fluid leakage will occur even under pressure. With reference to FIG. 2, it shows the wrist dispenser 1 positioned on the wrist and the nozzle 3 extended to overlay the palm of the hand. FIG. 3 also shows the application of compression with the wearer's opposing hand 5 using the back of the hand to avoid contamination of the wristband 1. The compression force first fills the dispensing chamber nozzle 3. With reference to FIG. 4, it shows the dispensing process of the stored fluid in the nozzle chamber 3 by squeezing the chamber from the base of 3 towards the palm of the hand 4. At the completion of the dispensing motion, nozzle 3 can again be refolded under wristband 1.

Figure 5:
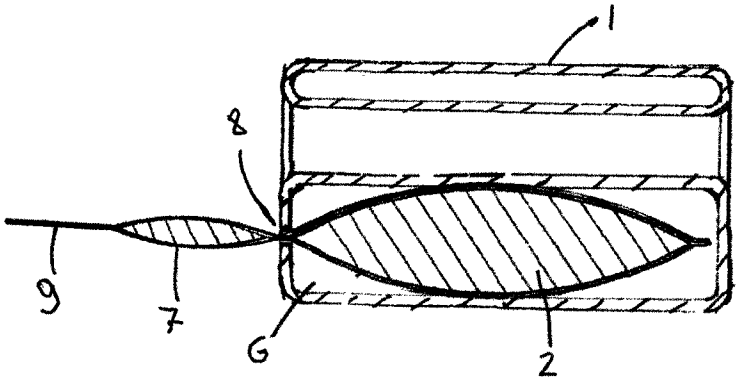
FIG. 5 shows a cross sectional view of the reservoir chamber positioned within the wristband compartment with the dispensing nozzle extended from a slit in the wristband.

With reference to FIG. 5 showing a cross-section of wristband 1 with the filled reservoir chamber 2, positioned in the wristband compartment 6. The dispensing chamber 7 is connected to the reservoir chamber via slit 8 in the wristband. The tip of the nozzle 9 directs the fluid to dispense into the palm of the hand 4. The refill cannulation is done via the end of nozzle 9.

The reservoir chamber 2 and dispenser nozzle 3 is preferably formed by heat sealing perimeter edges of two sheets of material to each other to form reservoir chamber 2 and the dispensing nozzle 3. The material is preferably plastic, such as high-quality polyurethane, but other materials may also be used, such as silicone and rubber. However, other bonding processes besides heat sealing may also be used.

The surface tension of the two sheets of material is sufficient to seal the dispensing nozzle where gates 12 and 15 (FIG. 8) act as a valve to prevent the leakage of fluid. This sealing mechanism provides a simple and economical way of sealing the reservoir chamber 2.

Figure 6:
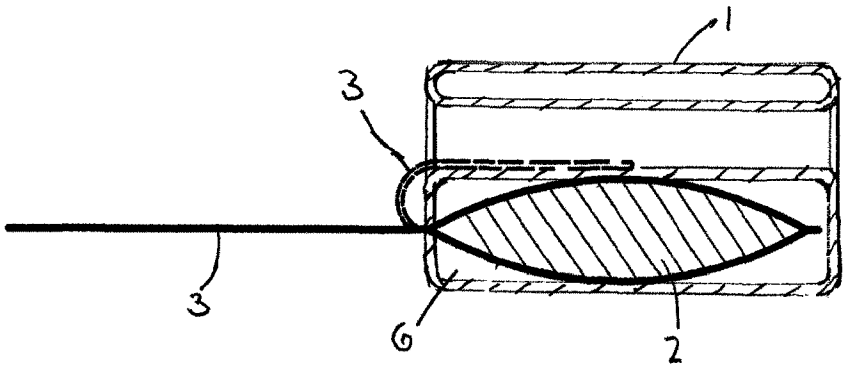
FIG. 6 shows the dispensing nozzle folded between the wristband and the storage compartment.

With reference to FIG. 6 showing how the emptied-out nozzle 3 is folded between the wrist located at the wristband 1 space 10 and the reservoir chamber 2 compartment 6.

Figure 7:
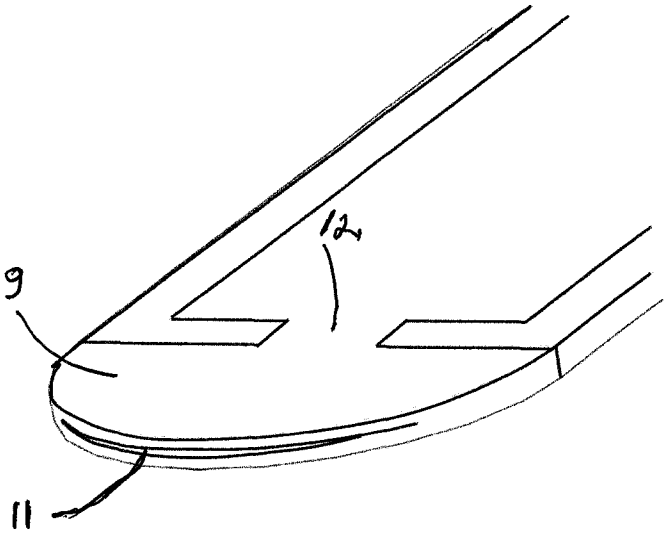
FIG. 7 is a magnified view of the dispensing tip and gate showing that refill tubing can be inserted by fitting the refill tube between the two layers of the dispensing outlet.

FIG. 7 is a magnified view of the nozzle tip showing the bilayer of tip 11 and the refill cannula inserted between layers of tip 11 and through the dispensing nozzle outlet gate 12.

Figure 8:
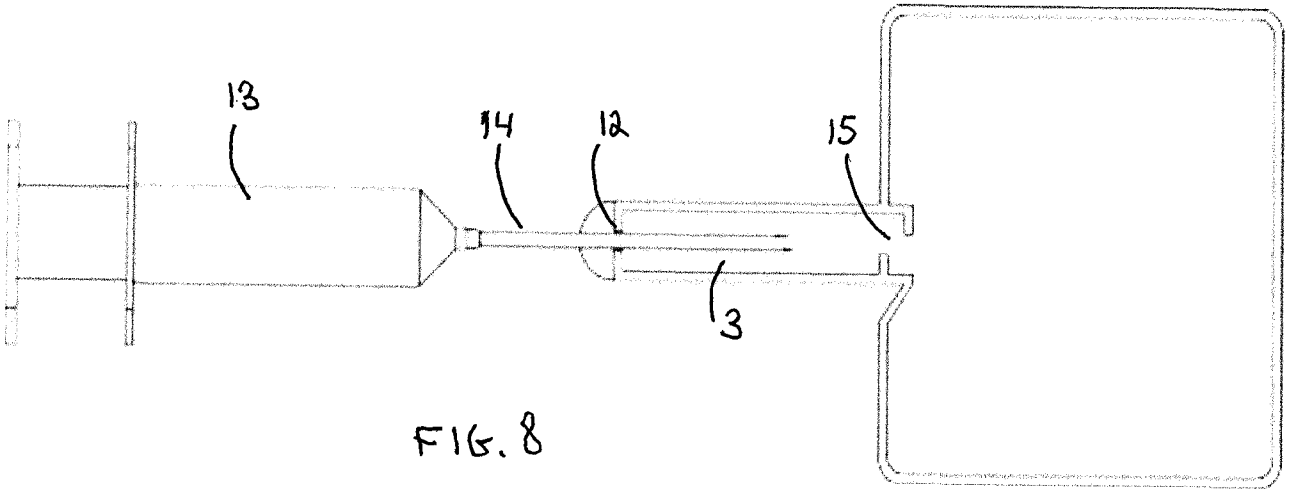
FIG. 8 depicts the position of the refill tubing attached to a syringe with the refill tubing disposed inside the dispensing chamber.
Figure 9:
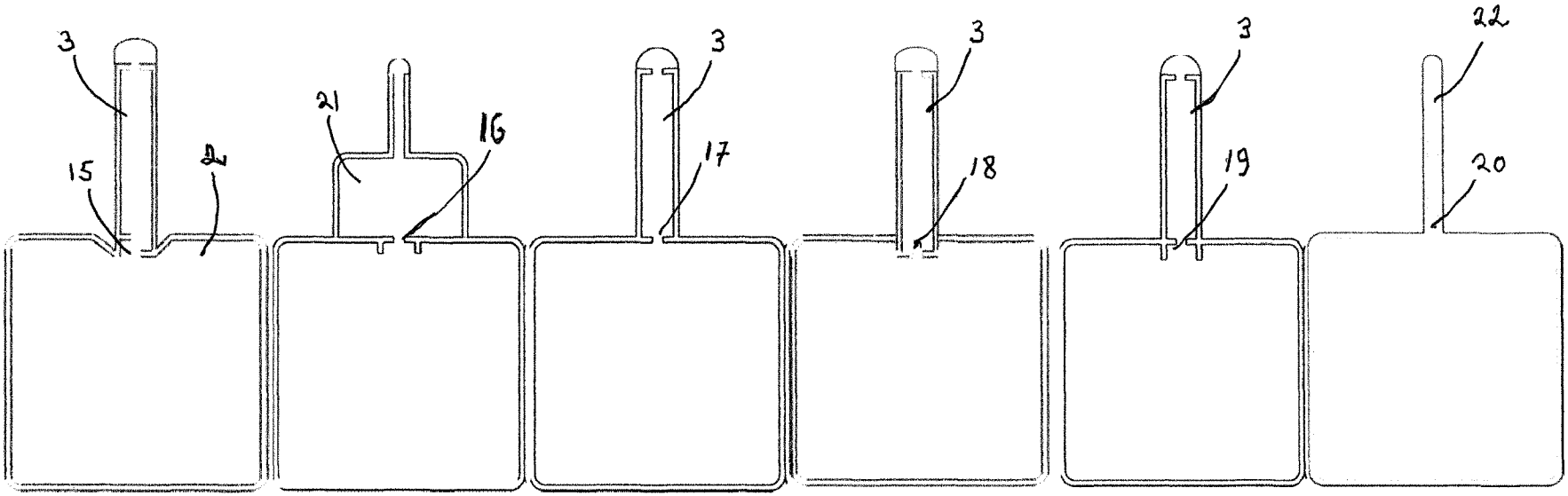
FIG. 9 depicts a series of gating and dispensing chamber and nozzle configurations that are specific for the various fluid viscosities that may be employed.

FIG. 8 depicts a refill syringe 13 equipped with a delivery tube 14 that is position across the dispensing chamber outlet gate that seals around the tube 14 and prevents spillage. It further shows the reservoir chamber gate structure 15 which is found to be most suitable for gel-type fluid. The dispensing chamber 3 may be sized to contain 3 cc of gel that has been formed to be most suitable for gel sanitizer. With reference to FIG. 9, it shows a series of gate configurations 15, 16, 17, 18, 19. No storage outlet gate is shown in configuration 20. Gate configuration 15 has been effective for dispensing gel fluid and low viscosity creams. Configurations 16, 17, 18, and 19 more adaptable for pure fluids. Configuration 20 has no gate on either side of the nozzle and may be useful to more viscous liquids.

Dispensing chamber 3 defines the dosing for each application and dispenses 2-3 cc which had been found to be the proper dosing for hand sanitation using a gel sanitizing fluid. When larger dosing is needed, an example of a larger dispensing chamber is depicted in configuration 21. A larger width of dispensing chamber 3 is also a way to increase the dispensing dose. Configuration 22 in FIG. 9 has no dosing chamber and the dispensing is direct to the hand.

Figure 10:
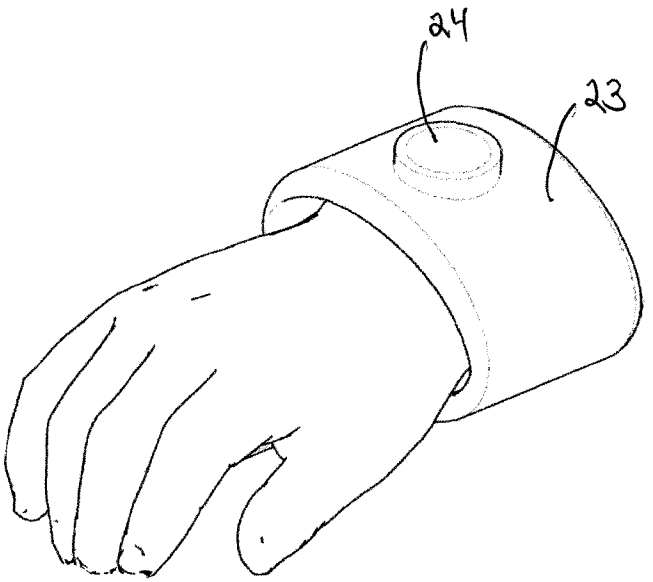
FIG. 10 depicts a wrist dispenser wristband that can accommodate a wristwatch either attached to the outer surface of the wristband where the wrist dispenser has a cutout that allows the wristband to fit over a watch.

FIG. 10 depicts a wristband 23 that can accommodate a watch or a similar device 24. The upper section of the wristband has an attachment or a cutout that allows the person to wear a watch and the wrist band 23 can also be placed over a worn watch with the display 24 visible.

Figure 11:
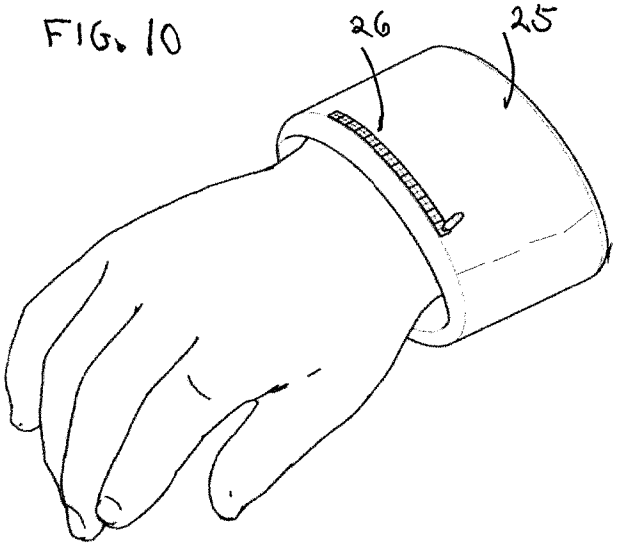
Figure 12:
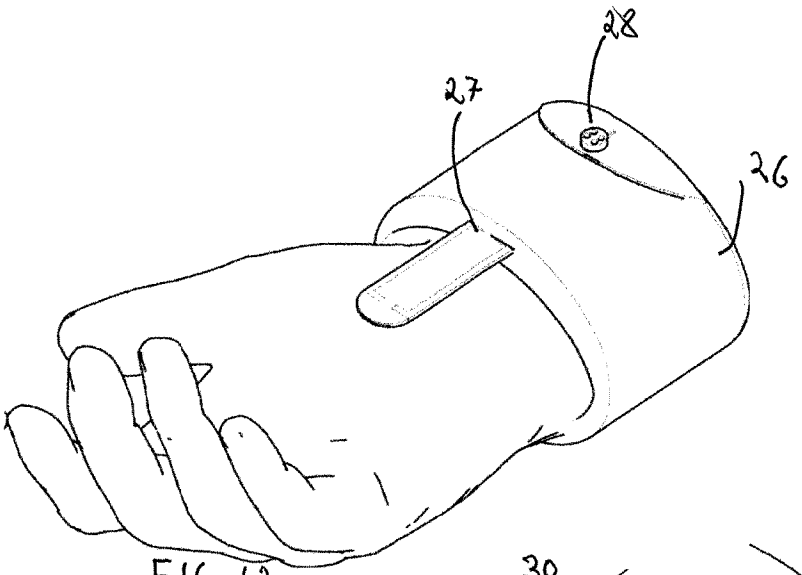
FIG. 12 depicts a liquid dispensing wristband with a refill one-way valve positioned at the back of the storage compartment.

FIG. 11 illustrates that the wristbands can be made of tubular material that can be divided into the medial as shown at 26 in FIG. 12. The reservoir chamber is located therein and the dispensing nozzle is exteriorized via a slit 27. In the outer chamber shown in FIG. 11, numeral 25 identifies the outer surface chamber that can be made with an opening placed in the front or the back of the wristband material that is equipped with a zipper 26 or another closure mechanism (such as Velcro) to create a pocket that can accommodate keys, a credit card, an ID, earphones, etc. Also, FIG. 12 depicts a one-way valve 28 attached to the reservoir chamber that allows direct refill of the reservoir chamber rather than via the dispenser nozzle.

Figure 13:
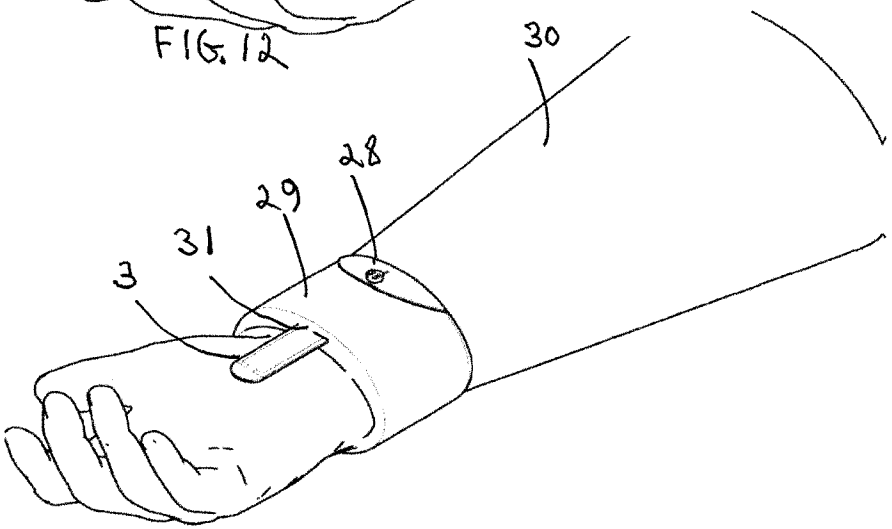
FIG. 13 depicts the placement of the wrist dispenser in a cuff of a shirt.

With reference to the embodiment of FIG. 13, the reservoir chamber 29 is placed in the cuff of a long sleeve shirt 30. The cuff is equipped with a slit 31 for the deployment of the dispensing nozzle 3. Refilling of the reservoir chamber can be accomplished via one-way valve 28 or via the cannulation of nozzle 3.

Figure 14:
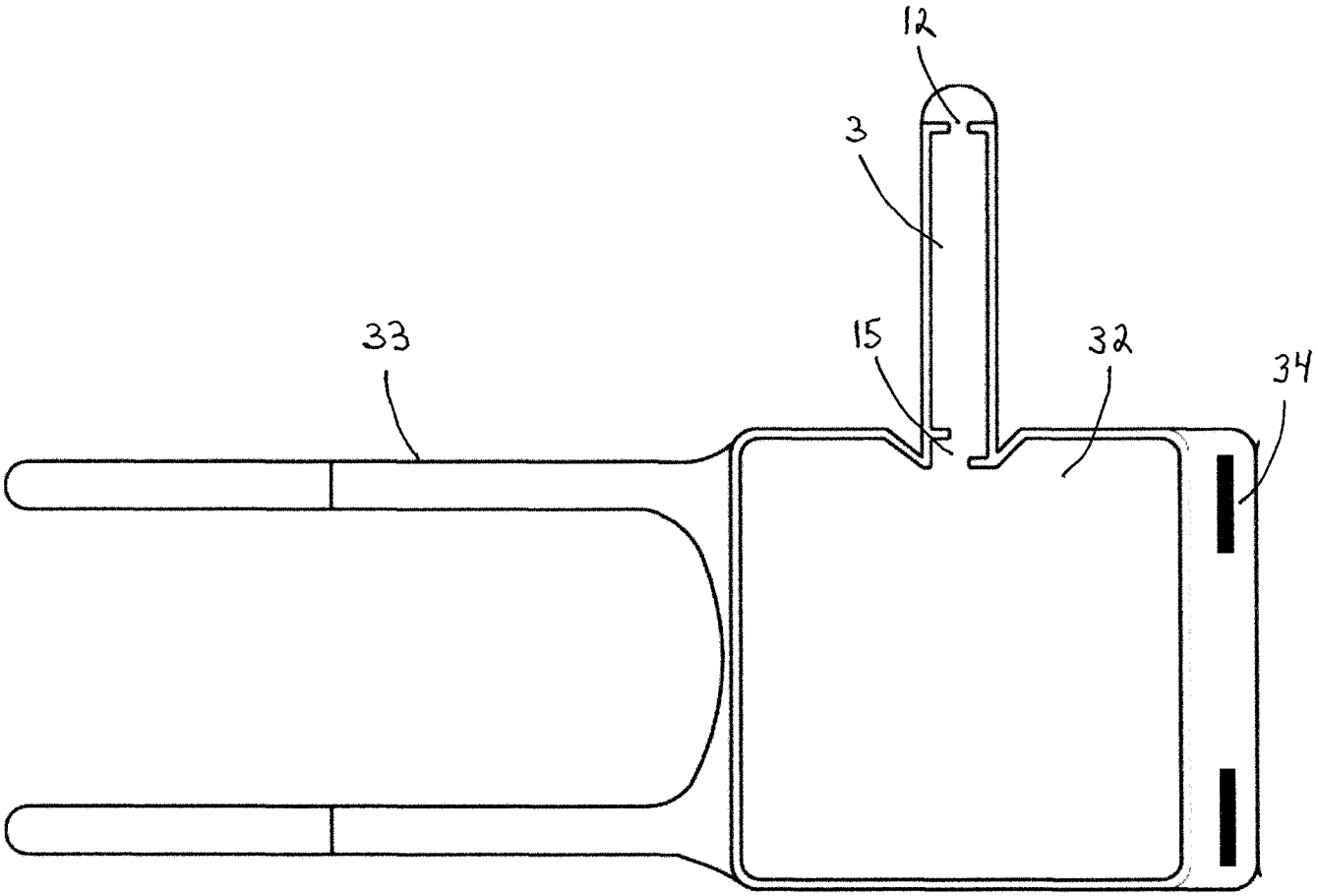
FIG. 14 depicts a wrist dispenser that is constructed of a single heat-sealed, double-layered polyurethane cut to contain a reservoir chamber, the dispensing nozzle equipped with appropriate gating, and using straps with Velcro or another strapping mechanism for attachment.

FIG. 14 is cheaper to manufacture hand sanitizer dispensing chamber 32, and nozzle 3 equipped with the same type of gates 15 and 12. In addition, the entire unit is made of double-layered polyurethane that is heat-sealed and fused together around all the outer edges. The unit is designed to be strapped around the wrist with straps 33 that are threaded through slits 34 and secured with Velcro or clips. In this configuration of the wrist dispenser, the dispensing nozzle 3 is bent and placed between the reservoir chamber and the wearer's wrist when not in use.

While particular embodiments of the invention have been shown and described, it will be obvious to those skilled in the art that changes and modifications may be made without departing from the invention in its broader aspects, and therefore, the aim in the appended claims is to cover all such changes and modifications that fall within the true spirit and scope of the invention.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A wrist-mounted liquid dispenser comprising:

a wristband having an interior cavity with a nozzle slit being formed at said wristband leading to said interior cavity; a dispenser pouch including a compressible reservoir chamber and a dispensing nozzle with an orifice formed between said dispensing nozzle and said reservoir chamber, wherein said compressible reservoir chamber of said dispenser pouch is adapted to be compacted and inserted into the interior of the wristband through said nozzle slit and further adapted to be unfurled within the interior of the wristband such that said dispensing nozzle extends out from the interior cavity through said nozzle slit, wherein said nozzle slit is self-sealing and adapted for refill cannulation.

2. The wrist-mounted liquid dispenser of claim 1 wherein said reservoir chamber is filled with one of a fluid, a gel or a cream.

3. The wrist-mounted liquid dispenser of claim 1 wherein said compressible reservoir chamber and said dispensing nozzle are formed by sealing perimeter edges of two flexible sheets of liquid impervious material to each other.

4. The wrist-mounted liquid dispenser of claim 2 wherein the dimension and shape of said orifice are determined by the viscosity of the fluid, gel or cream contained in said reservoir chamber.

5. A wrist-mounted liquid dispenser comprising:

a wristband having an interior compartment, a nozzle slit being formed in an end edge of said wristband to communicate with said interior compartment, a dispenser pouch having a reservoir chamber, a dispensing chamber, and a dispensing nozzle, there being a first orifice formed between said dispensing chamber and said reservoir chamber, and a second orifice formed between said dispensing chamber and said dispensing nozzle, wherein said dispenser pouch is adapted to be compacted and inserted through said nozzle slit into the interior compartment of the wristband, and further adapted to be unfurled when located within the interior compartment with the dispensing nozzle extending out from the wristband through said nozzle slit, wherein said nozzle slit is self-sealing and adapted for refill cannulation.

6. The wrist-mounted liquid dispenser of claim 5 wherein said reservoir chamber is adapted to be filled with a fluid by injecting said fluid into said reservoir chamber through said dispensing nozzle.

7. The wrist-mounted liquid dispenser of claim 5 wherein said dispenser pouch is formed by sealing perimeter edges of two sheets of moisture impervious sheet material to each other to form said reservoir chamber and said dispensing nozzle.

8. The wrist-mounted liquid dispenser of claim 5 wherein the width and shape of said first and second orifices are determined by the viscosity of fluid retained in said reservoir chamber and the force needed to express the fluid content thereof.

9. The wrist dispenser of claim 5 wherein said reservoir chamber of said dispenser pouch is compacted and inserted through said nozzle slit.

10. The wrist-mounted liquid dispenser of claim 5 wherein the dispensing nozzle has a polyurethane tip which is bilayer.

11. A wrist-mounted liquid dispenser comprising:

a wrist band made of high resolution printable elastic fabric sewn about a dispensing apparatus whereby printed indicia and coloring is rendered visible thereon, said fabric including a nozzle slit formed therethrough, the dispensing apparatus including a compressible storage pouch with a reservoir chamber and a dispensing nozzle and having an orifice formed between the reservoir chamber and the dispensing nozzle, the dispensing nozzle being extendable through the nozzle slit, the arrangement being such that when a fluid of a predetermined viscosity is contained in the reservoir chamber and a compressive force in excess of a predetermined value applied to the reservoir chamber the fluid is expelled through the dispensing nozzle directly onto a wearer's hand.

12. A wrist-mounted liquid dispenser of claim 11 wherein the high-resolution printable material sewn about the dispensing apparatus further includes a storage pocket accessible through a closeable opening formed through an exterior surface of the wristband.

13. The wrist-mounted liquid dispenser of claim 11 further comprising said reservoir chamber being filled with said fluid selected from a group consisting of liquid, gel or cream by injecting same into said reservoir chamber through said dispensing nozzle.

14. The wrist-mounted liquid dispenser of claim 11 wherein said dispensing apparatus is formed by sealing perimeter edges of two sheets of flexible elastomeric material to each other to form said reservoir chamber and said dispensing nozzle.

15. A wrist-mounted liquid dispenser of claim 14 wherein the dispensing nozzle is constructed to include a dosing chamber for allowing a predetermined amount of fluid to be extruded from the dispensing nozzle.

16. A wrist-mounted liquid dispenser of claim 14 wherein the elastomeric material is polyurethane formed such that the dispensing nozzle is self-sealing when empty.

17. A wrist-mounted liquid dispenser of claim 16 wherein the dispensing nozzle forms a high-pressure seal when folded back between the wrist and the wristband.

18. The wrist-mounted liquid dispenser of claim 11 wherein the size of the said orifice is determined by a viscosity of the fluid retained in said reservoir chamber a force desired to express the fluid.

19. The wrist-mounted liquid dispenser of claim 11 wherein said reservoir chamber of said storage pouch is adapted to be compacted for insertion through said nozzle slit.

20. The wrist-mounted liquid dispenser of claim 11 and further including a dispenser insertion slit formed in the wristband that is offset from the nozzle slit.

21. The wrist-mounted liquid dispenser comprising a compressible fluid storage chamber including at least one strap for securing the compressible liquid storage chamber to a wrist of a wearer, a compressible dispensing tubular nozzle in fluid communication with the fluid storage chamber and of a length sufficient to reach a palm of the wearer's hand.

22. The wrist-mounted liquid dispenser of claim 21 and further including a first flow control gate proximate a junction between the fluid storage chamber and the compressible dispensing tubular nozzle and a second flow control gate proximate an end of the tubular nozzle.

* * * * *